United States Patent [19]

Larsson et al.

[11] Patent Number: 4,617,229

[45] Date of Patent: Oct. 14, 1986

[54] NON-WOVEN FABRIC, A BITUMINOUS WATER-PROOFING MEMBRANE BUILT UP ON IT, AND THE USE OF THE FABRIC AS A CARCASS IN SUCH A MEMBRANE

[75] Inventors: Leif Larsson, Falun; Bengt Ekdahl, Höganäs, both of Sweden

[73] Assignees: AB Mataki, Höganäs; Storalene AB, Falun, both of Sweden

[21] Appl. No.: 679,452

[22] Filed: Dec. 7, 1984

[30] Foreign Application Priority Data

Dec. 9, 1983 [SE] Sweden ..... 8306820

[51] Int. Cl.[4] ..... D04H 1/08

[52] U.S. Cl. ..... 428/284; 428/280; 428/282; 428/288; 428/291; 428/297; 428/489; 428/913

[58] Field of Search ..... 428/280, 290, 291, 289, 428/297, 301, 326, 492, 913, 282, 288, 489

[56] References Cited

U.S. PATENT DOCUMENTS

| | | | |
|---|---|---|---|
| 3,940,540 | 2/1976 | Schmidt | 428/280 |
| 4,392,861 | 7/1983 | Butterworth et al. | 428/286 |
| 4,425,126 | 1/1984 | Butterworth et al. | 428/198 |
| 4,472,243 | 9/1984 | Bondoc et al. | 428/489 |
| 4,545,854 | 10/1985 | Gomez et al. | 428/288 |

*Primary Examiner*—James J. Bell

*Attorney, Agent, or Firm*—Burns, Doane, Swecker & Mathis

[57] ABSTRACT

A non-woven fabric for use as a bitumen coated and possibly bitumen impregnated carcass in a water-proofing membrane, particularly for roofs, is distinguished in that a proportion of at least 75% by weight of the fabric fibers comprise organic synthetic fibers, preferably polyester fibers, and cellulose fibers, preferably wood pulp fibers, the organic synthetic fibers constituting at least 10 and at most 90% by weight of this fiber proportion. The non-woven fabric is coated with a binder compatible with bitumen in an amount of at least 10%, preferably at least 20% of the fabric weight, the binder being selected so as to be thermally stable up to a temperature of at least 160° C. and for limiting the water transport ability of at least the cellulose fibers. The invention also includes water-proofing membranes including a carcass formed by such fabric, which is coated and possibly impregnated with bitumen. The invention also includes the use of such a non-woven fabric as the carcass in such a water-proofing membrane.

25 Claims, No Drawings

NON-WOVEN FABRIC, A BITUMINOUS WATER-PROOFING MEMBRANE BUILT UP ON IT, AND THE USE OF THE FABRIC AS A CARCASS IN SUCH A MEMBRANE

TECHNICAL FIELD

The invention relates to a non-woven fabric of the kind apparent from the preamble to the accompanying main claim. The invention also relates to the use of such a non-woven fabric as the carcass of a bituminous water proofing membrane. Furthermore, the invention relates to a bituminous water proofing membrane with a carcass formed from the non-woven fabric.

BACKGROUND

Bituminous water proofing membranes, e.g. in the form of roofing felt, conventionally consist of a carrier or carcass formed by woven, or non-woven fibers which are coated with and possibly impregnated with bitumen (asphalt).

Rag paper is used today as the carcass in the production of roofing felt. Rag paper has the advantage of a relatively low price, and gives the roofing felt an appropriate break elongation for certain applications, but the roofing felt produced has some less good properties, primarily one of taking up water. This results in that the water turns into vapour, which in different places lift the upper bituminous layer of the felt and forms so-called blisters or bubbles. The blisters thus occurring have a tendency to crack and allow further penetration of water. If the surface of the felt is granulated, the granules will fall off to a certain extent due to the formation of blisters, UV protection of the felt thus being reduced and as a result its strength and life also.

Glass fiber therefore appear to be a suitable material for the carcass, due to the unwillingness of the glass fiber material to take up and be affected by water, but carcasses formed from glass fiber have less favourable mechanical properties, e.g. a break elongation of about 2%, which is insufficient, taking into account the movements which the substructure of roofing felt normally has, these movements being transferred to the felt. The result may be that roofing felt cladding formed with a glass fiber carcass cracks. Polyamide fibers have been tried as carcasses for bituminous water proofing membranes, but have been found to be too thermally sensitive in conjunction with manufacturing of the membrane, since asphalt is applied to the carcass at a temperature of about 160° C.

Carcasses made from polyester fibers have been found to be favourable with respect to several mechanical properties, but have unsatisfactory dimension stability in a warm state, e.g. in connection with applying the bitumen, and have a very unfavourable cost in comparison with carcasses from rag paper, glass fiber fabric and the like. Even so, polyester fiber fabric has gained use as carcass for roofing felt. Due to the deficient heat dimension stability of the polyester fiber fabric, the carcass should have a superficial weight of at least 150 g/m$^2$, preferably 170 g/m$^2$, for being able to meet stability requirements in conventional manufacture of roofing felt.

It has further been attempted to produce roofing felt carcasses from a mixture of glass fibers and polyester fibers, with the object of avoiding the unfavourable properties of the polyester fiber carcass, but the fiber fabric thus produced has a utilizable elongation determined by the break elongation of the glass fibers, which makes a mixed fiber fabric of this kind unsuitable.

Wood pulp fibers have always been regarded as unusable for carcasses intended for bituminous water proofing membranes. For example, base felt which is to be used as a rag paper carcass for roofing felts, shall have a greatest content of 15% by weight of wood pulp fibers, with mechanical pulp fibers not exceeding 5% by weight.

One object of the invention is to provide a non-woven fabric for use as carcass for bituminous water-proofing membranes, e.g. in the form of roofing felt or sarking felt, this fabric giving the membrane acceptable insensitivity to moisture, acceptable dimension stability during and after manufacture of the membrane and having acceptable elongation and elasticity as well as being relatively thin, i.e. with a superficial weight of 150 g/m$^2$ or less.

A further object of the invention is to give directions as to the use of a non-woven fabric in accordance with the invention as a bitumen carrier in a water proofing membrane such as roofing felt, where the membrane complies with the requirements applicable to its use.

A still further object of the invention is to achieve a non-woven fabric for the purpose mentioned, the fabric containing a substantial portion of cellulose fibers, particularly plant fibers.

CHARACTERIZATION OF INVENTION (DISCLOSURE OF INVENTION)

According to the invention it has been surprisingly found that a carcass or carrier for bitumen based water-proofing membranes, e.g. roofing felt, can well replace and compete with conventional carcasses and avoid some of the unfavourable properties of the latter in such water proofing membranes, if the carcass comprises a non-woven fabric according to claim 1. The cellulose fibers may consist of such as wood pulp fibers, sisal fibers or hamp fibers. The organic synthetic fibers may consist of polyester, polyamide or polyacryl fibers (such as polyacryl nitrite fibers). The non-woven fabric shall be coated with a binder which is compatible with bitumen and which has the capacity of binding the fibers of the non-woven fabric so that the fabric may be handled in conjunction with conventional manufacture of bituminous water-proofing membranes. Furthermore, the binder shall be present in an amount of at least 10, preferably at least 20% by weight of the fabric. The binder may be of the latex type, preferably a mixture of methylmethacrylate and ethylacrylate. The remainder of the fiber quantity in the fabric may consist of such as glass fibers or polypropene fibers. The reinforcing synthetic fibers utilized in the inventive non-woven fabric, apart from giving it appropriate strength, shall also be substantially thermally stable at a temperature of about 160° C. (the temperature of the bitumen when applying to a carcass in the manufacture of a water-proofing membrane). Furthermore, the synthetic fibers should have a break elongation such that the break elongation of the membrane will be sufficient with regard to the movement of the substructure, and thus attain to at least 3%, preferably more, e.g. at least 5%, or at least 6%.

The synthetic fibers should preferably also be insensitive to moisture and lack any propensity to take up water.

As an example of synthetic fibers for the inventive non-woven fabric may be mentioned polyester fibers, and these fibers should have a gage in the range of 1.7 to 17 dtex.

The synthetic fibers may have a length of up to 50 mms and preferably between 12 and 35 mms.

The cellulose fibers of the inventive fabric are to advantage wood pulp fibers, but may also be sisal fibers, hamp fibers etc.

The binder has been found to give the effect of preventing the transport of water in the cellulose fibers. It is possible that the binder covers the fibers projecting out from the main surfaces of the fabric, but it also appears to be the case that the binder collects in the intersections of the fibers to block or prevent water transport at these points. In any case, it has been found that a latex binder applied to the fabric in the quantity mentioned prevents water penetration via the cellulose fibers into the fabric, when the latter is coated with bitumen to form a bituminous water proof membrane.

It is surprising that as carcass in a bitumen-type water proofing membrane with conventional thickness of the bitumen coatings a non-woven fabric may be used which contains cellulose fibers without the membrane life being shortened or its properties rapidly deteriorated with time, as is the case with membranes based on rag paper etc.

A salient cost advantage is gained already in that the reinforcing synthetic fibers such as polyester fibers together with cellulose fibers, can be diluted in respect of the carcass or non-woven fabric, especially when the cellulose fibers consist of wood pulp fibers.

A further advantage of the invention is that in comparison with a carcass of polyester fibers by themselves, the cellulose fiber content has been found to stabilize the fabric so that its dimension stability is improved, particularly in conjunction with applying hot bitumen, but also for the finished sealing membrane product. The superficial weight of the fabric or carcass can thus be reduced without dimension stability becoming poor. In comparison with a conventional carcass consisting of polyester fibers by themselves, the inventive mixture of such as wood pulp fibers and polyester fibers in a carcass for bitumen sealing material has a synergic effect.

With regard to minimization of the carcass fiber cost, it is naturally desirable to have as large a cellulose fiber proportion as possible in the fabric, and especially of fibers from wood pulp.

As mentioned, the binder for the fabric can to advantage consist of an acrylate, which is applied in the form of a latex to the substantially dry non-woven fabric produced in a conventional machine. The binder not only serves to bind the fibers of the fabric to each other, but also, as mentioned, has a quite special effect with relation to the use of the fabric as a carcass or carrier in a bitumen sealing membrane.

It has namely been found that fibers quite naturally project out from the main surfaces of the fabric. These fibers will later thrust into and through the bitumen layer which is applied to the carcass in the production of the water proofing membrane. The projecting fibers are advantageous and possibly actually necessary for affording reinforcement or anchoring of the asphalt layer to the carcass. But the fibers extending through the bitumen layer of the membrane can suck in water to its carcass when it consists of certain materials. By applying the binder to the fabric in accordance with the invention and to a specified extent, the fibers projecting out from the chief surfaces of the fabric will also be affected by the binder so that they can no longer suck in water to the membrane carcass. The fibers which are thus affected are normally the cellulose fibers, while the reinforcing organic synthetic fibers are usually selected such that they lack the property of sucking up water. By this effect of the binder in relation primarily to the cellulose fibers it is now possible with the sealing membrane of the kind in question to utilize a non-woven fabric containing a substantial proportion of cellulose fibers even so, which absorb water or are affected by water or water-carried contaminants.

For an inventive non-woven fabric with a relatively large proportion of cellulose fibers, the synthetic fiber proportion affords an appropriate reinforcement of the fabric, thus enabling a reduction of the superficial weight of the fabric.

Both fiber types in the fabric are preferably uniformly distributed and preferably bonded by the binder.

The fabric can be produced in the following way.

A stock is prepared from water and both fiber types in the mentioned proportions thereof, and spread out on a Fourdrinier wire in a non-woven fabric-making machine, a dry fabric essentially composed of the fibers thus being formed. The fabric is then coated with the binder on its chief surfaces with the aid of a sizing press, or a spraying or foaming method, the binder being allowed to penetrate to a desired extent into the fabric for binding its fibers to each other, after which the binder on the fabric coated therewith is allowed to dry and harden, e.g. in a throughflow drier coupled to the machine.

The fabric can be subjected to a temperature of more than 200° C. in such a drier. If the fabric contains thermoplastic fibers, such as polypropene fibers, then these will at least partially melt and later, in a cold state, form a binder for the remaining fibers in the non-woven fabric. The mentioned organic synthetic fibers of the fabric should be stable at the conditions occurring during the application of hot bitumen to the fabric (at least 160° C.) and for the possible heat treatment of the fabric during its production.

The membrane is usually produced by a web of the non-woven fabric being taken through a bath of hot bitumen (about 175° C.) which impregnates and coats the fabric.

The cellulose fibers may comprise bleached and/or unbleached coniferous sulphate pulp or the like, which has a conventional fiber length, usually greater than 2 mm.

The main proportion of the fabric fibers consists of organic synthetic fibers and cellulose fibers, allowing the remaining proportion of fibers to be selected for giving the fabric desired properties during manufacture of the membrane and/or giving the membrane further desired properties in its use, such as roofing felt or the like. A minor proportion of the fiber quantity in the fabric may thus include thermoplastic fibers such as mentioned above, or glass fibers, for example. The invention and preferred embodiments thereof is disclosed in the accompanying claims.

The invention will now be described in detail with reference to the following working examples.

WORKING EXAMPLES

Example 1

A non-woven fabric with a superficial weight of 125 g/m$^2$ was produced in a conventional machine. The fabric comprised 40% by weight of fibers from bleached coniferous sulphate pulp and 60% by weight polyester fibers, based on the total fiber content of the fabric. The fabric produced by the machine thus contained no binder. Of the polyester fibers 60% by weight had a length of 34 mm and 40% by weight a length of 18 mm. The fabric produced in the machine was dried conventionally and subsequently sprayed with an acrylate latex on both each chief surfaces, after which the latex coated fabric was taken through a drying oven for drying and curing the binder. The thickness of the fabric provided with binder was about 0,8 mm. The properties for a roofing-felt produced on a carcass consisting of the inventive non-woven fabric thus produced are accounted for in Table 1 below, giving the mean value of five sets of measurements. In manufacturing the roofing felt, the carcass consisting of the non-woven fiber was impregnated conventionally with bitumen before surface coating with bitumen, and the resulting roofing material, which is primarily a sarking felt, had a superficial weight of 2500 g/m$^2$.

TABLE 1

| | Longitudinal | Transverse |
|---|---|---|
| Tensile strength at 0° C. (kN/m): | 12,9 | 9,4 |
| Ultimate elongation at 0° C. (%); | 14,3 | 16,1 |
| Tearing strength at 25° C. (N): | 32,0 | 32,8 |
| Elongation with retained sealing (density) at −10° C. (%): | >3 | >3 |
| Punch strength at 20° C. (N): | | |
| chisel: | 145 | |
| cylinder: | 673 | |
| Water absorption (% for 24 h): | 0,05 | |
| Water absorption (% for 7 days): | 0,15 | |
| Imperviousness to water (1 m head of water for 24 hours): | impervious | |

As a comparison it may be mentioned that if a roofing-felt corresponding to the one according to Example 1 is manufactured with a carcass or carrier consisting of a conventional polyester non-woven fabric, the roofing felt does indeed obtain better values in a number of cases, but the relative dimension stability of the polyester non-woven fabric results in that a surface weight for it of about 170 g/m$^2$ must be selected to obtain a carcass acceptable in this respect in the production of a roofing felt, or an appropriately dimensionally stable sealing membrane formed from a roofing felt produced on the basis of a polyester fiber non-woven fabric.

Example 2

A non-woven fabric with a superficial weight of 125 g/m$^2$ was produced on a conventional non-woven fiber making machine. Counted on the fiber proportions in the fabric, it consisted of 60% by weight of fibers from bleahced coniferous sulphate pulp oand 40% by weight of polyester fibers. The fabric thus produced by the machine contained no binder. 100% by weight of the polyester fibers had a length of 34 mm. The fabric produced by the machine was dried conventionally and subsequently sprayed with an acrylate latex on both its chief surfaces, the fabric thus coated then being led through a drying oven for drying and curing the binder. The thickness of the binder-coated fabric was about 0,7 mm. The properties for a granulate-coated roofing felt produced on a carcass consisting of the fabric according to this example are accounted for in Table 2 below, which shows the mean values for five measurements. In manufacturing the roofing felt the carcass consisting of the fabric was conventionally impregnated with bitumen before surface coating with bitumen and the resulting roofing felt had a superficial weight of about 4000 g/m$^2$, the granulate coating having a superficial weight of about 1500 g/m$^2$.

TABLE 2

| | Longitudinal | Transverse |
|---|---|---|
| Tensile strength at 0° C. (kN/m): | 12,5 | 10,1 |
| Ultimate elongation at 0° C. (%): | 10,0 | 9,6 |
| Tearing strength at 25° C. (N): | 23,8 | 24,8 |
| Elongation with retained sealing (density) at −10° C. (%): | >3 | >1 |
| Punch strength at 25° C. (N): | | |
| chisel: | 129 | |
| cylinder: | 595 | |
| Water absorption (% for 24 h): | 0,01 | |
| Water absorption (% for 7 days): | 0,06 | |
| Imperviousness to water (1 m head of water for 24 hours): | impervious | |

As a comparison it may be mentioned that if a roofing-felt corresponding to the one in Example 2 is manufactured with a carcass or carrier comprising a conventional rag paper (superficial weight 600 g/m$^2$), the roofing felt according to Example 2 had better values in most cases excepting tensile strength, although here it should be noted that the tensile strength of the rag paper carrier deteriorates heavily with time.

The binder in the inventive non-woven fabric according to Examples 1 and 2 is a latex binder mixture, consisting of 80% by weight of a methylmethacrylate type and 20% by weight of an ethylacrylate type. The fabric in Examples 1 and 2 contains 20% by weight of binder and 80% by weight of fibers.

The cellulose fibers in the fabric according to Examples 1 and 2 has a mean fiber length of at least 2 mm.

The mentioned proportion of the fiber quantity in the fabric comprises organic synthetic fibers and cellulose fibers, which are preferably separate.

We claim:

1. A non-woven fabric for use as a bitumen coated carcass in a water proofing membrane comprising fibers a proportion of at least 75% by weight of the amount of said fibers in the fabric comprising organic synthetic fibers which are heat stable up to at least 160° C. and natural cellulose fibers, the organic synthetic fibers constituting at least 10% and at most 90% by weight of said fiber proportion and the cellulose fibers constituting the remainder of said proportion, the fabric having applied to it a binder compatible with bitumen in an amount of at least 10% of the fabric weight, said binder being thermally stable up to a temperature of at least 160° C., and being selected for limiting the propensity to transport moisture, at least in respect of the cellulose fibers.

2. Fabric as claimed in claim 1 wherein said fiber proportion contains at most 80% by weight of cellulose fibers.

3. Fabric as claimed in claim 1 wherein the fiber proportion contains at least 30% by weight of cellulose fibers.

4. Fabric as claimed in claim 1 wherein the synthetic fibers and cellulose fibers are uniformly distributed in the fabric.

5. Fabric as claimed in claim 1 wherein the synthetic fibers have an average length of at least 18 mm.

6. Fabric as claimed in claim 1 wherein the synthetic fibers are polyester fibers.

7. Fabric as claimed in claim 1 wherein the cellulose fibers are wood pulp fibers.

8. Fabric as claimed in claim 1 wherein the proportion constitutes at least 85% by weight of the amount of fibers in the fabric.

9. Fabric as claimed in claim 8 wherein the proportion constitutes substantially 100% of the fiber quantity in the fabric.

10. Water-proofing membrane comprising a non-woven fabric coated with bitumen said fabric comprising fibers, a proportion of at least 75% by weight of the fiber quantity of the fabric comprising organic synthetic fibers and cellulose fibers, the organic synthetic fibers constituting at least 10% and at most 90% by weight of said fiber proportion, with the cellulose fibers constituting the remainder of said proportion, the fabric being coated with a binder compatible with bitumen in an amount of at least 10% of the fabric weight and the binder being selected to be thermally stable at least up to 160° C. and to limit the moisture transport ability of at least the cellulose fibers.

11. Use of a non-woven fabric in accordance with claim 1, as a carrier or carcass for water proofing membrane coated with bitumen.

12. Fabric as claimed in claim 1 wherein said fiber proportion contains at most 60% by weight of cellulose fibers.

13. Fabric as claimed in claim 1 wherein the fiber proportion contains as least 40% by weight of cellulose fibers.

14. Fabric as claimed in claim 2 wherein the fiber proportion contains at least 30% by weight of cellulose fibers.

15. Fabric as claimed in claim 2 wherein the fiber proportion contains at least 40% by weight of cellulose fibers.

16. Fabric as claimed in claim 2 wherein the synthetic fibers and cellulose fibers are uniformly distributed in the fabric.

17. Fabric as claimed in claim 2 wherein the synthetic fibers have an average length of at least 18 mm.

18. Fabric as claimed in claim 2 wherein the synthetic fibers are polyester fibers.

19. Fabric as claimed in claim 2 wherein the cellulose fibers are wood pulp fibers.

20. Fabric as claimed in claim 2 wherein the proportion constitutes at least 85% by weight of the amount of fibers in the fabric.

21. The water-proofing membrane as claimed in claim 10 wherein said non-woven fabric is impregnated with bitumen.

22. The use as claimed in claim 11 wherein said non-woven fabric is impregnated with bitumen.

23. Fabric as claimed in claim 1 wherein said binder is a latex.

24. Fabric as claimed in claim 23 wherein said latex is a mixture of methylmethacrylate and ethylacrylate.

25. Fabric as claimed in claim 1 wherein said non-woven fabric is impregnated with bitumen.

* * * * *